United States Patent [19]

Yarwood et al.

[11] Patent Number: 4,606,397

[45] **Date of Patent: * Aug. 19, 1986**

[54] APPARATUS AND PROCESS FOR ELECTRO-MAGNETICALLY FORMING A MATERIAL INTO A DESIRED THIN STRIP SHAPE

[75] Inventors: John C. Yarwood, Madison; Gary L. Ungarean, Woodbridge; Derek E. Tyler, Cheshire, all of Conn.

[73] Assignee: Olin Corporation, New Haven, Conn.

[ * ] Notice: The portion of the term of this patent subsequent to Sep. 18, 2001 has been disclaimed.

[21] Appl. No.: 625,288

[22] Filed: Jun. 27, 1984

Related U.S. Application Data

[63] Continuation of Ser. No. 488,848, Apr. 26, 1983, Pat. No. 4,471,832, which is a continuation of Ser. No. 213,125, Dec. 4, 1980, abandoned.

[51] Int. Cl.[4] ..... B22D 27/02

[52] U.S. Cl. ..... 164/467

[58] Field of Search ..... 164/467, 503, 498

[56] References Cited

U.S. PATENT DOCUMENTS

| | | | |
|---|---|---|---|
| 2,686,864 | 8/1954 | Wroughton et al. | 164/65 X |
| 3,096,158 | 7/1963 | Gaule et al. | 422/249 |
| 3,463,365 | 8/1969 | Dumont-Fillon | 222/544 |
| 3,467,166 | 9/1969 | Getselev et al. | 164/467 |
| 3,605,865 | 9/1971 | Getselev et al. | 164/503 |
| 3,985,179 | 10/1976 | Goodrich et al. | 164/503 |
| 4,004,631 | 1/1977 | Goodrich et al. | 164/503 |
| 4,161,206 | 7/1979 | Yarwood et al. | 164/467 |
| 4,242,553 | 11/1980 | Berkman et al. | 219/10.49 R |
| 4,321,959 | 3/1982 | Yarwood et al. | 164/503 |
| 4,353,408 | 10/1982 | Pryor | 164/503 |

FOREIGN PATENT DOCUMENTS

| | | |
|---|---|---|
| 1481301 | 7/1977 | United Kingdom . |
| 1499809 | 2/1978 | United Kingdom . |
| 2009002 | 6/1979 | United Kingdom . |

OTHER PUBLICATIONS

National Technical Information Service Report PB-248963, "Scale Up of Program on Continuous Silicon Solar Cells", by A. D. Morrison, Sep. 1975.

G. K. Gaule et al., "The Role of Surface Tension in Pulling Single Crystals of Controlled Dimensions", Metallurgy of Elemental and Compound Semiconductors, published by Interscience Publishers, Inc., New York, 1961.

*Primary Examiner*—Kuang Y. Lin

*Attorney, Agent, or Firm*—Howard M. Cohn; Barry L. Kelmachter; Paul Weinstein

[57] ABSTRACT

An apparatus and process for electromagnetically forming a material into a desired thin strip shape. The apparatus comprises a first portion for electromagnetically containing and forming the material in molten form into a cross-sectional shape substantially the same as the desired thin strip shape. A second portion receives the molten material in the thin strip shape from the first portion. In addition, the second portion reduces the distortion in the cross-sectional shape due to surface tension. The second portion includes a device for providing an electromagnetic field having a reduced strength as compared to the strength of an electromagnetic field in the first portion. The electromagnetic field may be reduced in strength by providing an inductor having hollow inner surfaces facing the molten material so as to form substantially straight vertical surfaces in the molten material. In another embodiment, a shield is provided between the inductor and the molten metal to selectively reduce the strength of the electromagnetic field.

5 Claims, 8 Drawing Figures

APPARATUS AND PROCESS FOR ELECTRO-MAGNETICALLY FORMING A MATERIAL INTO A DESIRED THIN STRIP SHAPE

This application is a continuation of application Ser. No. 488,848, now U.S. Pat. No. 4,471,832, filed Apr. 26, 1983, which in turn is a continuation of application Ser. No. 213,125, now abandoned, filed Dec. 4, 1980.

While the invention is subject to a wide range of applications, it is especially suited for use in electromagnetic casting of strip material and will be particularly described in that connection. The process and apparatus is preferably used to overcome the surface tension effects which occur during the shaping of thin semi-conductor ribbon in the liquid state.

It is believed, while electromagnetically casting or reforming thin strip semi-conductive materials, the tendency for surface tension forces to distort the shape of the molten material being formed into a thin strip may be a major problem. The problem results in poor, irregular shape control of the thin strip. The present invention substantially eliminates this problem and thereby provides consistency in the formation of uniform thin strip.

A variety of processes have been developed for forming semi-conductive materials such as silicon into a thin strip shape. Examples of such approaches can be found in National Technical Information Service Report PB-248963 "Scale Up of Program on Continuous Silicon Solar Cells" by A. D. Morrison, published in September 1975, and a paper entitled "The Role of Surface Tension in Pulling Single Crystals of Controlled Dimensions" by G. K. Gaule et al. from Metallurgy of Elemental and Compound Semiconductors, published by Interscience Publishers, Inc., New York in 1961, pages 201–226. The Morrison publication is exemplary of the state of the art with respect to the pulling of strip-type materials from a melt of silicon. The Gaule et al. publication is similarly exemplary and of particular interest insofar as it discloses the use of electromagnetic forces for applying external pressure at the growth interface.

In U.S. Pat. No. 4,353,408 M. J. Pryor, an electromagnetic thin strip casting apparatus and process is described which is adapted for forming thin strip castings of a variety of materials including semi-conductive materials such as silicon. In this apparatus, a specially-shaped inductor is utilized for containing a funnel shaped pool of molten material and for forming the material into the desired thin strip shape. The process can be carried out continuously or semi-continuously as desired.

In U.S. patent application, Ser. No. 158,040 filed June 9, 1980 by J. Winter, (now abandoned) an electromagnetic thin strip reforming apparatus and process is described which is adapted for forming thin strip castings of a variety of materials including semi-conductive materials such as silicon. In this apparatus, an input device conveys the starting strip of material to the electromagnetic apparatus to form the floating molten zone and an output device conveys thin strip of the material away from the electromagnetic device.

A considerable body of art has developed with respect to the use of electromagnetic containment for the purposes of casting metals. These electromagnetic casting apparatuses comprise a three-part mold consisting of a water cooled inductor, a non-magnetic screen, and a manifold for applying cooling water to the resultant casting. Such an apparatus is exemplified in U.S. Pat. No. 3,467,166 to Getselev et al. Containment of the molten metal is achieved without direct contact between the molten metal and any component of the mold. Solidification of the molten metal is attained by the direct application of water from a cooling manifold to the solidifying shell of the casting. An elaborate discussion of the prior art relating to electromagnetic casting is found in U.S. Pat. No. 4,161,206 to Yarwood et al. That prior art statement is intended to be incorporated by reference herein. The Yarwood et al. patent deals with a control system for controlling the electromagnetic process which is believed to have particular use in the apparatus of the present invention.

Non-magnetic screens of the prior art are typically utilized to properly shape the magnetic field for containing the molten metal as exemplified in U.S. Pat. No. 3,605,865 to Getselev. This patent teaches the provision of an electromagnetic screen with upwardly directed thickening so that the rate of attenuation of the magnetic field of the inductor is increased upwardly. This reference neither considers nor prevents the problem of surface tension because the ingots of molten metal being formed are sufficiently large to inherently substantially overcome this problem.

Another approach with respect to use of non-magnetic screens is exemplified in U.S. Pat. Nos. 3,985,179 and 4,004,631 to Goodrich et al. The '179 reference describes the use of a shaped inductor in conjunction with a screen to modify the electromagnetic forming field so that a gradually diminishing flux density is provided whereby the radial forces on the molten metal surface are gradually reduced toward the upper portion of the molten metal column to maintain the vertical surfaces of the molten metal essentially straight. This reference is not concerned with effects of surface tension because the ingot of molten metal is sufficiently large to override this consideration. The '631 reference is directed to an electromagnetic inductor provided with a coolant jacket which directs coolant onto the metal being cast.

U.S. application Ser. No. 54,463 filed, July 11, 1979 by Yarwood et al, now abandoned, as well as U.S. Pat. No. 4,321,959 to Yarwood et al. provide a non magnetic shield used in conjunction with an inductor to eliminate undesirable rounding-off of the corners of the molten metal in the casting zone. The control or shaping of the magnetic field by differential screening may also be accomplished by contouring the inductor. In either case, the effect on the molten metal is at its corners and is not concerned with the surface tension which has effects in thin strips of molten material.

A shaped inductor for molding molten material is disclosed in U.K. Patent Application No. 2,009,002 to Swiss Aluminum, Ltd. This reference teaches the concept of reducing the vertical dimension of an inductor of constant thickness in order to raise the current density in the conductor and the magnetic field strength at the location of reduced dimension. The aim of this invention is to produce ingots having a convex shape in the side walls whereby the shrinkage caused by the cooling of the ingots results in flat surfaces. This reference differs from the present invention in that it is concerned with the casting of rectangular metal ingots which are too large to notice any significant effect due to surface tension.

U.S. Pat. No. 3,463,365 to Dumont-Fillon and British Pat. No. 1,481,301 are exemplary of the art relating to the use of electromagnetic fields for controlling metal flow from a tundish or crucible into a mold. In the British patent, an electromagnetic field is not only used to control the flow of molten metal from the crucible but also to keep the molten metal from flowing against the refractory of a portion of the crucible to thereby reduce erosion of the refractory. In the British '301 patent, the crucible is relatively large in diameter as compared to the opening or nozzle through which the molten metal exits the crucible and is supplied to the mold.

In British Pat. No. 1,499,809, a rod casting system is provided utilizing a crucible and electromagnetic flow control arrangement similar to that described in the previous '301 British patent. However, in this case the electromagnetic coil which controls metal flow also serves to shape the metal into the desired rod shape which is then cooled with water to solidify it and rolled into a final desired rod or wire product.

The arrangements disclosed in the British patents, since they are a hybrid using both a crucible and electromagnetic forces for containment, suffer drawbacks in that the molten metal sump which is supported by the crucible is subject to contamination by the crucible. Further, in the arrangement of the British '809 patent, water from the cooling station could be splashed up between the molten metal and the crucible in the narrow neck portion and, thereby, subject the apparatus to potential explosive situations. In order to overcome these problems, in accordance with this invention an arrangement is provided whereby a large molten material pool or sump is supported above the narrow strip forming section of the electromagnetic mold wherein solidification takes place, solely by means of electromagnetic containment forces.

It is an object of the present invention to provide an apparatus and process for forming a material into a thin strip shape which substantially obviates one or more of the limitations and disadvantages of the described prior arrangements.

It is a further object of the present invention to provide an apparatus and process for electromagnetically forming a material into a desired thin strip wherein the distortion in the cross-sectional shape due to surface tension is substantially reduced.

It is a still further object of the present invention to provide an apparatus and process for electromagnetically forming a material into a desired thin strip shape wherein the electromagnetic field strength is lowered for reducing the distortion in the cross-sectional shape of the thin strip.

It is a yet further object of the present invention to provide a process and apparatus for electromagnetically forming a material into a desired thin strip shape in a manner which is relatively inexpensive to manufacture and operate.

Accordingly, there has been provided an apparatus and process for electromagnetically forming a material into a desired thin strip shape. The apparatus and process comprise a first portion for electromagnetically containing and forming the material in molten form into a cross-sectional shape substantially the same as the desired thin strip shape. A second portion receives the molten material in the thin strip shape from the first portion. In addition, the second portion reduces the distortion in the cross-sectional shape due to surface tension. The second portion includes a device for providing an electromagnetic field having a reduced strength as compared to the strength of an electromagnetic field in the first portion. The electromagnetic field may be reduced in strength by providing an inductor having hollow inner surfaces facing the molten material so as to form substantially straight surfaces in the molten material. In another embodiment, a shield is provided between the inductor and the molten metal to selectively reduce the strength of the electromagnetic field.

For a better understanding of the present invention, together with other and further objects thereof, reference is had to the following description, taken in connection with the accompanying drawings, while its scope will be pointed out in the appended claims.

Figure 1:
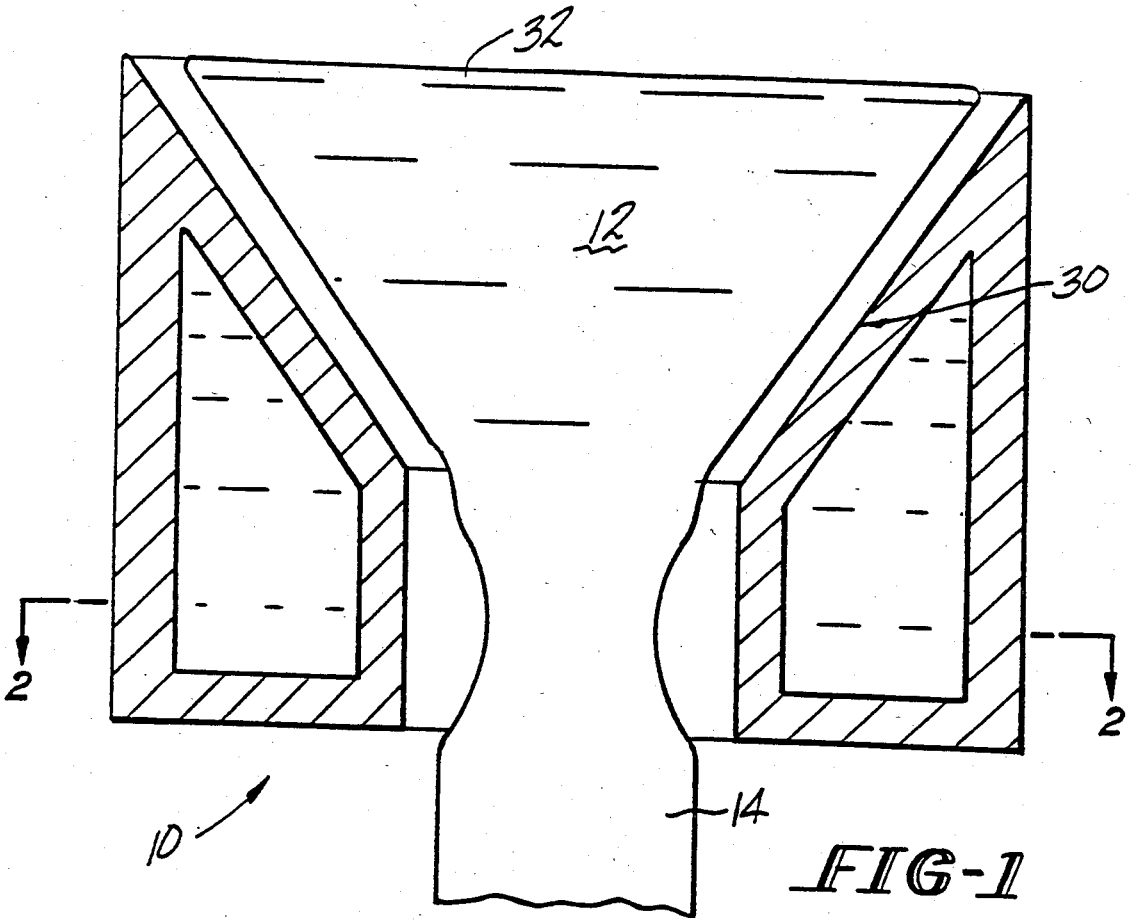
FIG. 1 is a schematic side view illustrating the problem of casting in accordance with the prior art.

An apparatus 10 is provided for electromagnetically forming a material 12 into a desired thin strip shape 14. The apparatus includes a first portion 16 for electromagnetically containing and forming the material in molten form 18 into a cross-sectional shape 20 substantially the same as the desired thin strip shape 14. A second portion 22 receives the molten material in the thin strip shape from the first portion 16 and reduces the distortion in the cross-sectional shape due to surface tension.

Figure 2:
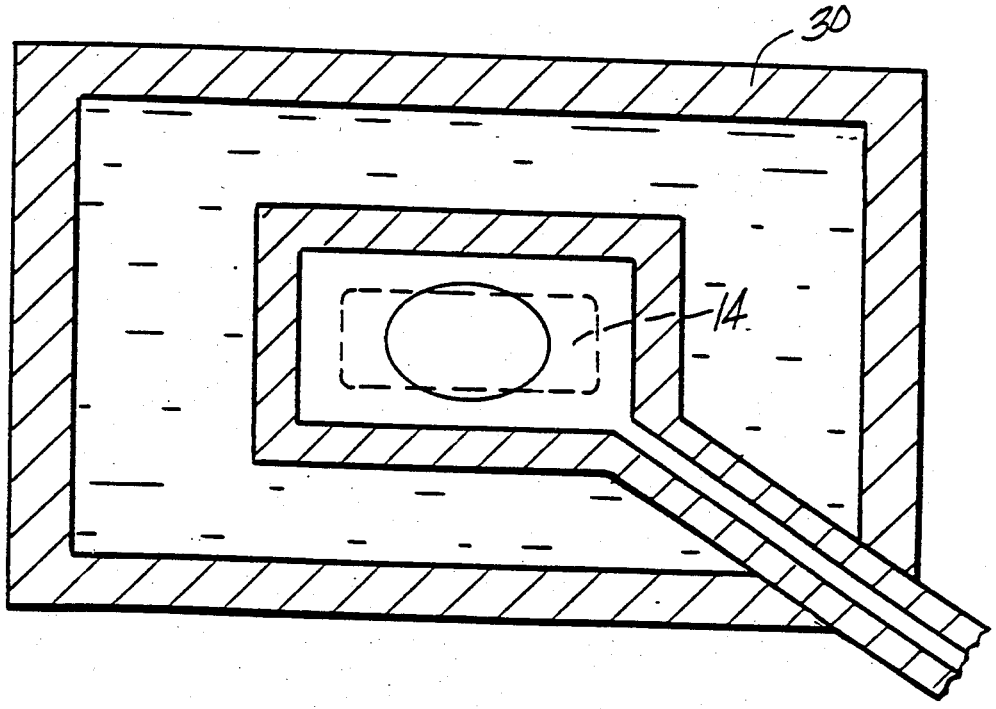
FIG. 2 is a view through 2—2 of FIG. 1.

Referring to FIGS. 1 and 2, there is shown a schematic of a prior art system for electromagnetic casting of thin silicon ribbon from a melt as more fully described in the above-mentioned Pryor patent. This system includes a shaped inductor 30 supporting a large sump 32. The inductor provides an electromagnetic force to form the molten material into a thin strip. One of the major problems, in this technique used for electromagnetically casting silicon, is the tendency for surface tension forces to minimize the large surface area to volume ratio of the liquid metal being formed and cast. The surface tension acts to begin shrinking the long transverse direction of the strip to form a section which is elliptical or ovoid, then circular and possibly even nipping off the strip entirely. This is shown in FIG. 2, where the tendency of the molten material, due to surface tension, is to begin necking down from the formed thin strip shown in dotted lines to the ovoid shape in solid lines. The material may then continue to neck down until it entirely pinches off. The large molten material sump 32 creates a substantial pressure head which counteracts the tendency of the surface tension to neck down the strip. However, when the molten material enters the section of the electromagnetic field where it is formed into a desired thin strip shape, the electromagnetic force from the inductor 30 acts in conjunction with surface tension forces to cause the tendency of necking down. It should be noted that the present invention is primarily used in the formation of thin strip shaped material which may have a thickness of approximately 0.1" or less. The problem of surface tension is particularly pronounced in the formation of such thin strip material. In the production of somewhat thicker or larger sized ingots of material, the problem of surface tension is less pronounced and may be negligible because of the relatively stronger effects of pressure head and gravity and the reduced electromagnetic effect within the molten material from the inductor.

Figure 3:
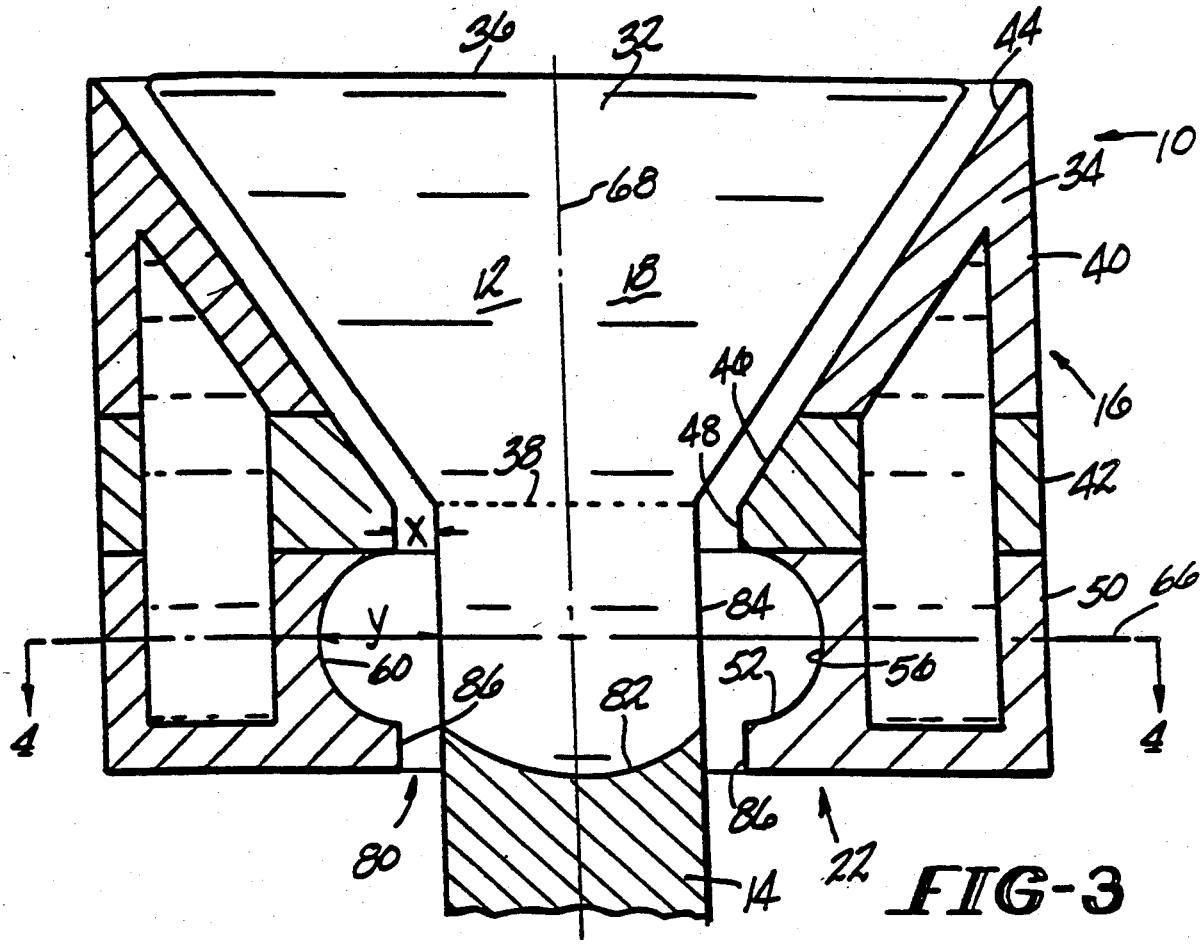
FIG. 3 is a schematic illustration showing a first embodiment of the present invention.
Figure 4:
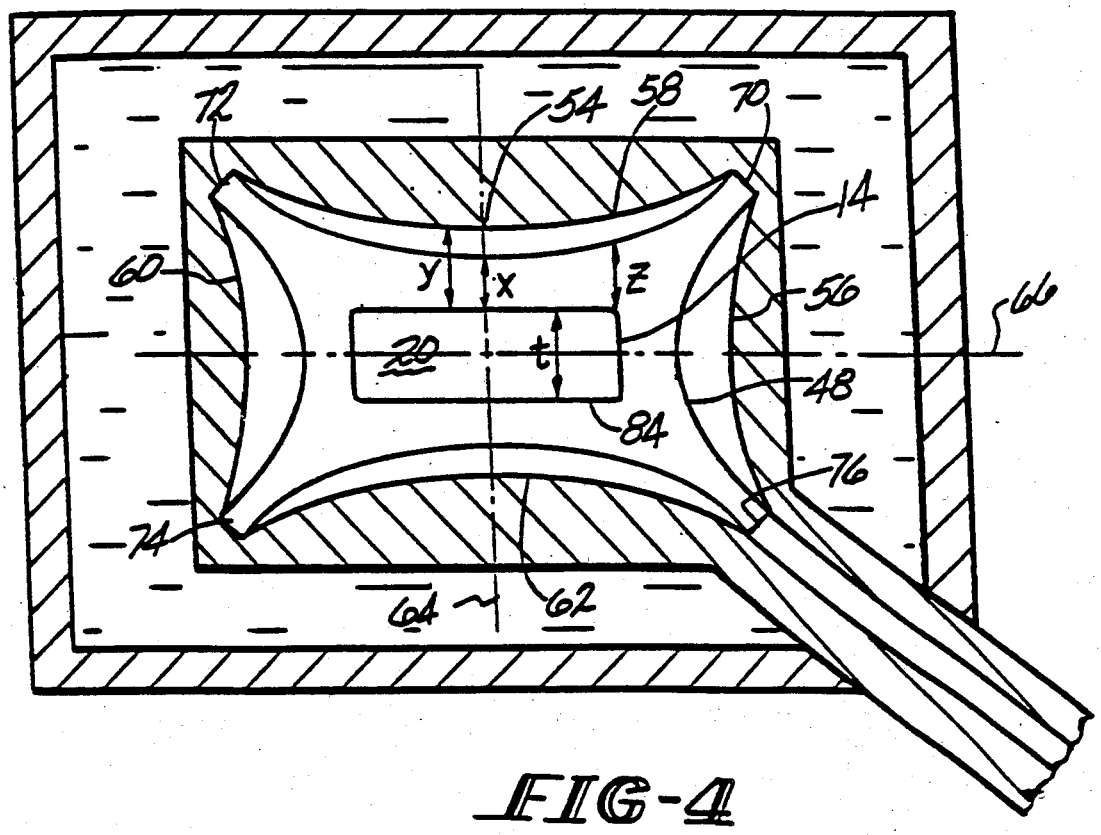
FIG. 4 is a view through 4—4 of FIG. 3.

Referring to FIGS. 3 and 4, there is shown a preferred embodiment of the present invention. A large sump 32 of molten material 12, such as for example silicon, may be provided. The sump 32 has a non-uniform cross section and flares out to create a top surface 36 of the molten material with a substantially larger cross-sectional area as compared to the cross-sectional area of a bottom surface 38 thereof. Preferably, the top surface has a cross-sectional area at least about five times as large as the cross-sectional area of the bottom surface and most preferably at least seven times larger. Note that the bottom surface 38 of the molten material has substantially the cross section of the thin strip shape 14.

The provision of a large sump in the present apparatus has a number of advantages. The sump contains a sufficiently large volume of molten material to insure the melting of additional material being fed into the sump without the creation of any significant temperature differentials. Also, the ability to control the temperature more precisely prevents premature solidification of the molten material in the apparatus. The large volume of molten material in the sump creates a larger hydrostatic pressure head which tends to reduce the problems with the surface tension as mentioned above. The height of the sump can be more easily controlled due to its larger volume whereby the hydrostatic pressure can be maintained substantially constant. Further, the flow of molten material from the sump can be precisely controlled which allows the hydrodynamic force to be held constant. This ability to reduce fluctuations in the hydrostatic pressure provides a resultant strip product of higher cross-sectional and thickness uniformity.

In the preferred embodiment shown in FIGS. 3 and 4, the electromagnetic containment zone providing first and second portions is achieved by means of a unique inductor 34 design. The first portion 16 may include an inductor section 40 combined with an inductor section 42. The first inductor section 40 has an inner surface 44 which faces the molten material and is generally flared outward to form a non-uniform cross section. Proceeding upwardly along the flared surface 44 of the inductor section from 40, the current density gradually decreases as the current path increases. This effect is desirable because the molten material head height which is supported at each succeeding point outwardly along the flared surface 44 decreases correspondingly. The angle of inclination of the surface 44 is preferably selected so that for the material being cast, there is a general balance between the current magnitude in the inductor and the hydrostatic pressure exerted by the molten material at each point in the inductor section 40 of the containment zone.

The first portion 16 may also include inductor section 42. The inductor section 42 has a flared surface 46 which, at one end, may be adjoined to, or in the same plane as, the lower edge of the flared surface 44. The other end of the surface 46 may be adjoined to a substantially vertical surface 48. As one proceeds downward along the flared surface 46, the current density increases as the current path decreases. This is necessary and desirable because the molten material head is correspondingly increasing. At the vertical surface 48, which is also included in section 42, the highest current magnitude developed in any inductor portion of apparatus 10 is required to force the molten liquid to neck down to the desirable shape which preferably has substantially the same cross-sectional shape as the desired thin strip shape.

The inductor sections 40 and 42 are herein described as together comprising the first portion 16 for electromagnetically containing and forming the material in molten form into a cross-sectional shape substantially the same as the desired thin strip shape. Nevertheless, the inductor sections 40 and 42 may preferably be individually powered in order to reduce the power requirements needed to operate the electromagnetic casting apparatus 10, as described in U.S. Pat. No. 4,353,408 to Pryor, hereby incorporated as a reference. As mentioned above, with the high cross-sectional area towards the top surface of the sump, a lower frequency is required to contain the molten material in the desired shape. By way of example, a frequency on the kilohertz range may be required to maintain the molten material away from the flared surface 44, while a frequency in the megahertz range may be required along the flared surface 46 or the vertical surface 48 to contain and form the molten material as desired. To individually power the inductors, they are separated. To separate the inductor sections 40 and 42, it may be desirable to employ an insulating gasket (not shown) between the two sections to electrically insulate the upper section 40 from the lower section 42. The purpose of insulating the sections from each other is to provide independent powering of each section in order to tailor the current levels in the surfaces 44, 46, and 48. Tailoring the power applied to each section 40 and 42 may necessitate the employment of two separate power supplies and control systems (not shown). In this way, the current applied to the upper section 40 may be totally different from the current applied to the lower section 42. The difference in current results in corresponding differences in the magnetic field strengths of the respective sections. This allows for improved balancing of the desired magnetic forces provided by the inductors 40 and 42 and the hydrostatic pressures exerted by the material being cast. Of course, the inductor sections 40 and 42 may be combined and operated by a single power supply and control system. The inductor lead connections 49 are attached to the power sources. The lead connections have been known to cause non-uniformity of the electromagnetic field. This problem is solved by making the lead connections at the corner as shown.

A second portion 22 receives the molten material in the thin strip shape from the first portion 16 and reduces the distortion in the cross-sectional shape due to surface tension. The second portion includes a device for providing an electromagnetic field having a reduced strength as compared to the strength of the electromagnetic magnetic field in the first portion 16. The device for providing an electromagnetic field may be an inductor section 50 which is arranged adjacent to the bottom surface or edge of inductor section 42. Section 50 may use an independent power supply and control. The inductors 42 and 50 may be separated by a gasket (not shown) in the manner described above concerning the separation of inductors 40 and 42. Although the inductor 50 is illustrated as being separate from the inductor section 42, it is within the scope of the present invention, and in fact may be desirable, to construct the inductors 42 and 50 as a single inductor and use a single power supply and control to operate this inductor.

The inductor section 50, as shown in FIGS. 3 and 4, has an inner surface 52 shaped to vary the electromagnetic field along the longitudinal of the molten material contained in the second portion 22. In addition, the inner surface 52 may also be shaped to vary the electromagnetic field in a transverse cross section through a molten material in the second portion.

The shaped inductor 50, which is used to provide an electromagnetic field in the second portion 22, has a hollow inner surface 52 facing the molten material so that substantially straight vertical surfaces are formed in the molten material. The hollow inner surface 52 is shaped to reduce the electromagnetic containment forces at the locations where the surface tension forces tend to neck the ribbon down.

As best seen in FIG. 4, the inner hollow surface 52 forms a substantially closed maximum inner periphery 54 which surrounds the molten material and is preferably formed by two pairs of arcuate side walls 56, 60 and 58, 62. The side walls of each pair are preferably substantially identical to and arranged opposite to each other. For example, walls 56 and 60 form one pair and walls 54 and 62 form the other pair. The arcuate walls 58 and 62 of one pair are wider than the walls 56 and 60 of the othe: pair so as to provide an inner cross-sectional area which roughly corresponds to the transverse cross-sectional area of the thin strip shape being formed. Of course, since side walls 56–62 are developed with compound curvatures and are spaced from the molten material, they cannot be said to have either the same shape or cross-sectional area as the actual transverse cross section of the thin strip.

The side walls of pairs (56, 60 and 58, 62) are preferably concave with respect to axes 64 and 66, respectively, which are arranged parallel to the side walls and extend through the transverse cross section of the shaped inductors and the thin strip shape. For example, the pair of side walls 56 and 60 are each concave with respect to the axis 64 which passes through the cross-sectional shape 20 of the thin strip shape 14. Also, the pair of side walls 58 and 62 are concave with respect to the axis 66 which extends through the transverse cross section of the thin strip shape.

Further, the side walls of each pair are also convex. They may be viewed as being convex with respect to their respective axes 64 and 66 which are arranged perpendicular to the side walls and extend through the transverse cross section of the shaped inductors and thin strip shape. The pair of side walls 56 and 60 besides being concave, as seen in FIG. 3, are also convex with respect to an axis which both extends through the transverse cross section of the shaped inductor device and extends into the side wall which is convex. For example, referring to FIG. 4, the side wall 56 is convex with respect to the axis 66 extending through the side wall 56. Side wall 60, which is the other side wall of the pair comprising walls 56 and 60, is also convex in the opposite direction from that of wall 56. Likewise, side walls 58 and 62 are convex with respect to the axis 64 and are positioned opposite one another.

The closed inner periphery 54 of the side walls 56–62 includes recessed corners 70–76 to prevent an excessive electromagnetic field from being formed at the corners of the cross-sectional shape 20. Here again, the electromagnetic containment forces are reduced at the locations where surface tension forces tend to neck the ribbon down. The straight edge, illustrated at each corner of periphery 54 in FIG. 4, has the general concave shape of the inner hollow surfaces 52. The recessed corners are adjoined to the side walls with transitional curvature as necessary. Although the recessed corners are shown in cross section with a straight edge, it is within the scope of the present invention to modify the shape of the recessed corners as necessary. For example, the corners may be of any other geometrical configuration in order to reduce the electromagnetic field which is imposed on the corners of the strip.

A third portion 80 is located downstream and directly adjacent to the second portion 22. The third portion produces an electromagnetic field which acts in conjunction with the surface tension in the thin strip shape to apply a pressure at the liquid to solid boundary 82 around the periphery 84 of the thin strip material for balancing the hydrostatic pressure head in the molten material whereby the desired thin strip shape is maintained. The third portion is formed with a surface wall 86 which is shown in the preferred embodiment as having the substantially identical shape as the vertical surface wall 48 which has an inner periphery shown in FIG. 4 as a solid line. It is also within the scope of the present invention to form the surface wall 86 of the third portion with other shapes, such as for example rectangular shape having recessed corners. This latter configuration is possible because a thin shell has preferably already solidified around the periphery of the thin strip shape whereby the surface tension forces no longer act to pinch in the molten material being cast. In addition, the electromagnetic field, which is generated by the third portion, may not require such a great reduction because it may not be as strong as the electromagnetic field generated by the surface 48. This is due to the absence of an electromagnetic field below the third portion to join with the electromagnetic field generated at surface 86. In contrast, the electromagnetic field generated by the vertical surface 48 may be joined with the electromagnetic field from the inductor surfaces located above and below surface 48.

An analytical approach to the problem of obtaining thin strip shape silicon material having a uniform cross section suggests an apparatus having several portions with electromagnetic fields of varying strength. The strength may be altered by varying the distance between the surface of the inductor and the material being cast. The actual curvature of the inductors is basically a function of the desired thin strip shape geometry, air gap between the thin strip shape and the inductors, the hydrostatic head and the surface tension forces. Depending on these and other factors, the geometry of the apparatus may have to be altered in order to cast the thin strip shape uniformly and without any necking down.

In order to more fully understand the invention, a consideration of the curvature and relationship between the curvature of the inductor surface follows. In general, the invention provides one or more inductors having various inner surfaces developed with compound curvatures. The compound curvatures are generally arranged in such a way as to reduce the electromagnetic containment pressure in the areas of the silicon molten strip from which surface tension tends to expel molten material. At the same time, the compound curvatures are shaped so as to increase the containment pressure in the areas into which the surface tension tends to push or inject the expelled liquid. Using this type of technique, castings with large surface areas can be formed in a controlled uniform manner.

Referring to FIG. 4, the thickness (t) of the thin strip shape may be in the order of approximately 0.1 to 2.5 millimeters. Also, the narrowest inductor-thin strip separation (x) should be minimized to keep power dissipation to a minimum. The separation (x) is preferably in the order of 1–10 millimeters. The distance between the thin strip shape and the side walls 56–62 is represented by (y) in FIG. 4. The preferred range of the ratio y/x is contemplated to be between 1.1 and 10. The distance (z) between the thin strip shape and the vertical surface 48 or the surface wall 86 may vary in accordance with the requirements of the particular type and dimensions of the material being cast. The preferred range of the ratio z/x is 1.1 to 5. Thus, it can be appreciated that the distance from the walls of the inductors to the thin strip shape may vary in any number of ways.

Although the geometry of the apparatus in the embodiment of FIG. 4 is substantially symmetrical, it is possible and may be desirable to vary the distances from the thin strip shape to the inductors in a non-symmetrical manner. In this way, the electromagnetic force field generated by a pair of side walls may be greater than the electromagnetic force field generated by the other pair of side walls. Since the surface tension acts to first draw in the thin strip shape along its width, it may be desirable to generate the greater electromagnetic force field by the wider pair of side walls 58 and 62 as compared with the narrower side walls 56 and 60. In order to alter the electromagnetic force field, it is only required to change the distance from the thin strip shape to the inductor wall.

To more fully understand the present invention, a description of its operation follows. In order to electromagnetically form a material into a desired thin strip shape, the first step required is to deliver the material such as silicon in molten form to a large sump 32. The sump contains the material in molten form by an electromagnetic field created by an inductor section 40. As the molten material moves towards the bottom of the sump, its transverse cross-sectional area reduces until finally it is formed into a thin strip shape having a cross-sectional shape substantially the same as the desired thin strip shape. This shaping occurs substantially at the junction between the flared surface 46 and the vertical surface 48 of the inductor section 42. The electromagnetic force at the vertical surface 48 is the maximum field developed in the apparatus and is required to be high in order to force the material to neck down to the desired shape. Generally, this requires a very high frequency field to perform this function.

After the material is formed into the desired shape, it continues to move downstream. During this downstream movement, the tendency of the material is to continue necking down due to the surface tension forces acting in conjunction with the electromagnetic field which is required to contain the molten material in the desired shape. In order to prevent the necking down and possible complete pinching off of the material, the molten material in the formed thin strip shape is received in a second electromagnetic field of portion 22 which reduces the distortion in the cross-sectional shape due to the surface tension. This second electromagnetic field is provided by an inductor 50 having a compound arcuate hollow inner surface 52 facing the molten material. The strength of the second electromagnetic field at the periphery of the molten material may preferably be reduced as compared to the strength of the first electromagnetic field at the periphery of the molten material. The reduction in strength, due to the increased air space between the inductor and the material, prevents the electromagnetic force from joining with the surface tension forces and causing the material to neck down. As the molten material moves further downstream, within the second portion the hydrostatic pressure head gets higher and tends to spread the molten material outward. At this point, the surface tension needs some additional assistance to actually maintain the molten material in the desired shape. This assistance comes in the form of the electromagnetic field being increased by moving the surface of the inductor back towards the periphery of the molten metal. The electromagnetic force field is increased until it applies a pressure at the periphery of the molten material, which in conjunction with the surface tension of the molten material, substantially balances the hydrostatic pressure head at the liquid to solid boundary 82 in the molten material whereby the thin strip shape is maintained.

The preferred embodiment has described the use of compound curvature in order to alter the electromagnetic force field of the inductors. A single turn type of inductor is preferable for this embodiment. This type of inductor allows considerable flexibility for the current to distribute itself and concentrate in local regions of lower electrical impedance. However, it is also within the scope of the present invention to use a multiple turn inductor as more fully set forth in U.S. patent application Ser. No. 9,429 to Gaule et al. now abandoned, which is hereby incorporated as a reference. In this case, the compound curvatures are eliminated and replaced by the placement of the coil turns. In such an inductor, the current is the same in each turn of the coil so that the electromagnetic field can be adjusted by changing the location and number of turns. Of course, it is also within the scope of the present invention to use an inductor combining multiple coil turns and compound curvatures as required.

Figure 5:
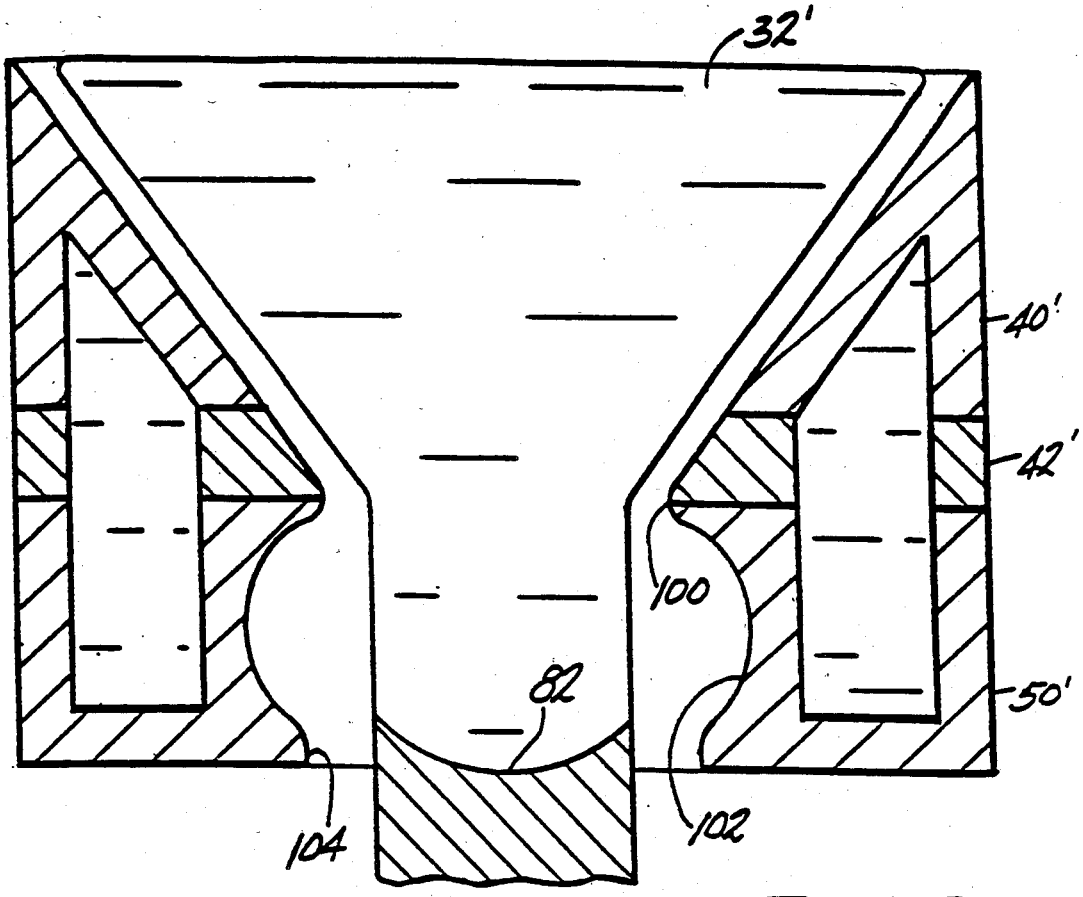
FIG. 5 is a schematic illustration showing a second alternative embodiment of the present invention.

A second embodiment of the present invention is illustrated in FIG. 5. The second embodiment is similar to the first embodiment and uses the numbers of the first embodiment primed wherever the components are substantially identical. As in the first embodiment, a large sump 32' is contained by a first electromagnetic field created by inductor 40' and inductor 42'. The molten material is formed into the desired thin strip shape by the first electromagnetic field at a transition point 100. The transition point 100 joins the flared surface 46' and the inner surface 102 of an inductor 50'. The transition surface 100 may perferably be formed with a small radius and is the smallest cross section through which the molten material flows. As in the surface 48 of the first embodiment, the transition surface 100 may have a convex shape with recesses located at the corners.

As inductor 50' includes a hollow inner surface 102 which is substantially identical to the inner surface 52 and may have a varying curvature as described hereinabove regarding surface 52. The electromagnetic force from inductor 50' constitutes the second electromagnetic field.

Adjoined to the downstream side of arcuate surface 102, a short inductor surface 104 is provided to create an electromagnetic force field which acts in conjunction with the surface tension in the thin strip shape to apply a pressure at the liquid-solid boundary 82' around the periphery of the thin strip material for balancing the hydrostatic pressure head in the molten material. The effect is to maintain the desired thin strip shape. The air gap between the surface 104 and the thin strip shape may be greater than the air gap between the transition surface 100 and the thin strip shape.

The embodiment of FIG. 5 operates substantially the same as the embodiment of FIGS. 3 and 4. Although the inductors 40', 42', and 50' are illustrated as being separate, the apparatus may be formed of any number of desired inductors, as with the previous embodiment. Also, the electromagnetic force field may be varied by changing the shape of the inductor surfaces, varying the air gap between the inductor surfaces and the thin strip, using inductors with multiple coils or any combination of these approaches.

Figure 6:
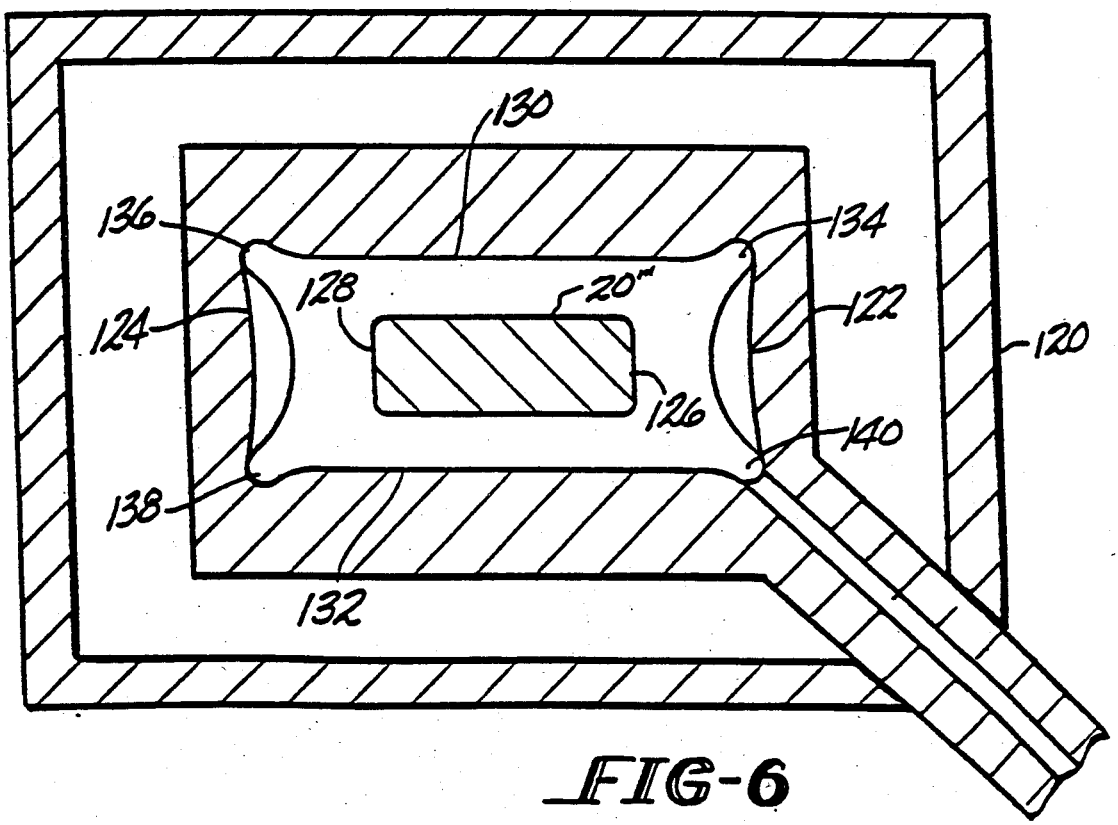
FIG. 6 is a schematic illustration of a third embodiment of the present invention.

Referring to FIG 6, there is shown a third embodiment of the present invention. The illustrated view corresponds to the tranverse cross-sectional view of FIG. 4. In this third emobidment, a shaped inductor 120 has a vertical cross section that is substantially identical to the vertical cross section of the embodiments illustrated in FIGS. 3 or 5. However, by comparing the third embodiment of FIG. 6 to the second embodiment of FIG. 4, it can be understood that the hollow, concave side walls 122 and 124 of the third embodiment are only provided opposite the narrow end walls 126 and 128, respectively, of the cross-sectional shape 20'''. In addition, the electromagnetic field may be formed with multiple coil inductors, varying air gap between the inductor and the molten material or changing the frequency of the inductors. The wider side walls 130 and 132 of the inductor 120 may be flat vertical surfaces. This embodiment does not necessarily require the concave or convex surfaces in these wider walls because the surface tension effect primarily changes the thin strip into an eliptical or ovoid shape. Thus, the reduction in the electromagnetic field may be primarily required at the surfaces 126 and 128 of the cross-sectional shape 20'''.

It can also be appreciated that the four recessed corners 134–140 reduce the electromagnetic force on the molten material to allow the corners of the thin strip shape to have as small a radius as possible. These recessed corners are curved so as to join the adjacent side walls such as 122 and 130 together. Although the recessed corners are illustrated as being curved, it is within the scope of the present invention to shape them in any desirable way so as to provide a suitable reduction in the electromagnetic force at the corners of the shape 20'''.

A further embodiment of the present invention (not shown) is substantially the same as that shown in FIG. 6 except the surfaces 130 and 132 may be concave as shown in FIG. 3 without the convex portion of the curvature. Another possible embodiment (not shown) is the provision of a convex curvature in the surface walls 130 and 132 as described above with regards to the embodiment illustrated in FIG. 4 but without any concave surface.

Figure 7:
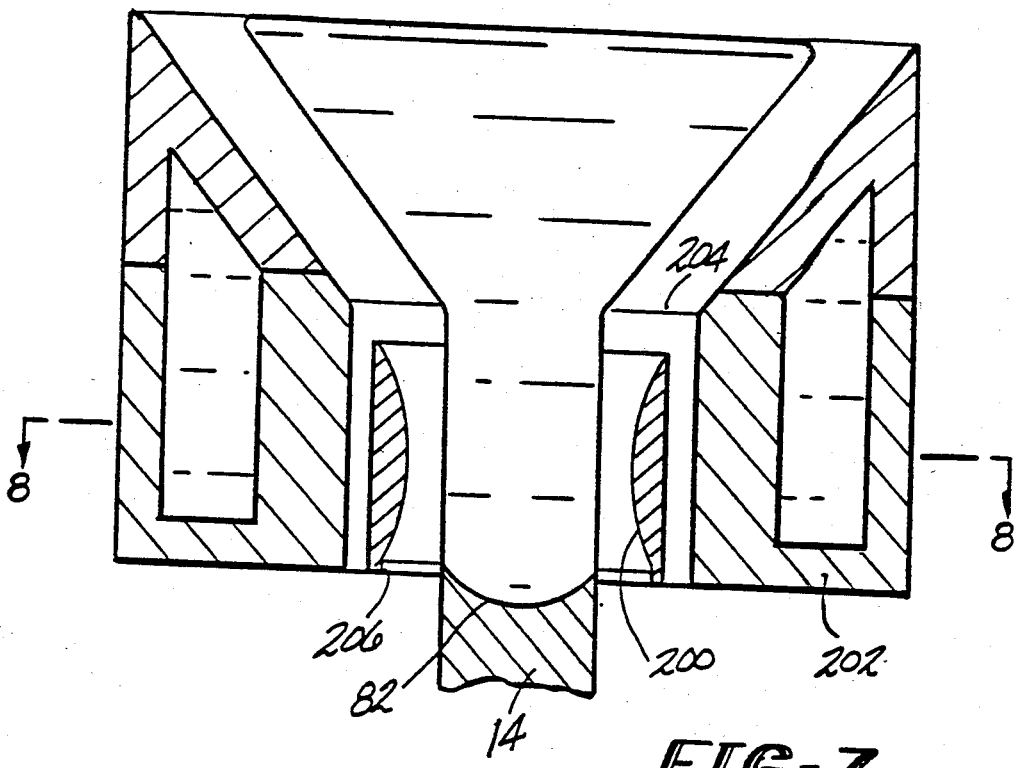
FIG. 7 is a schematic illustration of a fourth embodiment of the present invention incorporating a non-magnetic shield.
Figure 8:
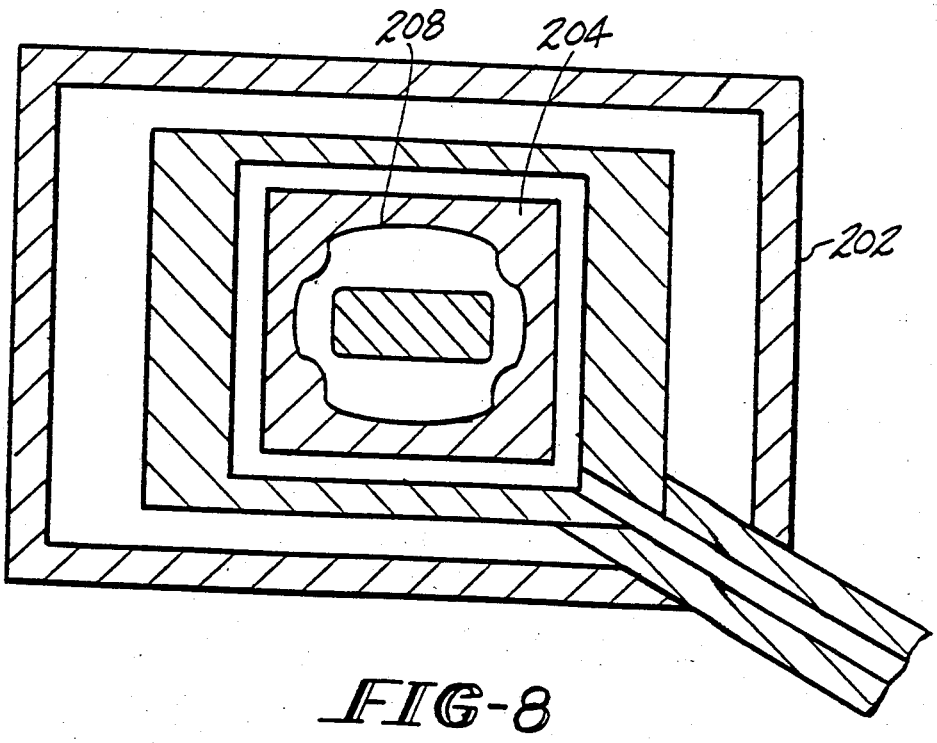
FIG. 8 is a view through 8—8 of FIG. 7.

A still further embodiment of the present invention is illustrated in FIGS. 7 and 8. In this embodiment, the device for providing an electromagnetic field having a reduced strength is a non-magnetic shield or screen 200. Increased local screening resulting in decreased electromagnetic force can be achieved by locally increased shield depth, by locally changing the shield section or any other technique as described in U.S. Pat. No. 4,321,959 to Yarwood et al., the disclosure of which is herein incorporated by reference. As best seen in FIG. 7, the non-magnetic shield or screen 200 is located between the inductor 202 and the thin strip shape 14. The top edge of the shield 204 may be adjacent the portion of the molten material where the surface tension would first cause the thin strip shape to begin to neck down as shown in FIG. 1 herein. As the tendency of the surface tension to neck off the thin strip shape increases, the thickness of the shield also increases so as to decrease the electromagnetic field on the thin strip shape. Then, as the molten material gets closer to the liquid to solid line 82'''', the static head increases and the shield begins to become thinner in order to allow the electromagnetic force from the inductor 202 to support and maintain the shape of the thin strip. Finally, the shield is greatly reduced at its lower edge 206 which is in line with the liquid to solid line and is of a thickness whereby the electromagnetic force generated by the inductor in conjunction with the force from the static tension of the material balances the hydrostatic pressure of the molten head.

Referring to FIG. 8, it can be seen that the shape of the screen 204 is varied around its inner perimeter 208 so that the deepest section of the shield is opposite the corners of the molten material so that the electromagnetic force is lowered in the areas where the static tension force has the strongest effect. Referring to the embodiment of FIGS. 3 and 4, it can be appreciated that the depth of the shield at any particular location may vary in order to balance the static tension and hydrostatic forces in the molten material.

The shield may be made of a large range of materials that do not melt at the temperature of the molten material being cast. These include materials, such as for example, stainless steel, tantalum, hafnium, or molybdenum. In addition, the shield may require a system of secondary cooling such as water.

While the invention has been described generally by reference to silicon, it is applicable to a wide range of semi-conductor materials as well as various metals, metal alloys, metalloids, or semi-metal type materials which could find application in electronic devices. Further, the materials may be doped or undoped as desired.

Although the present invention has been generally described with a sump that is contained by an electromagnetic device such as an inductor, it is also within the scope of the present invention to substitute a crucible to hold the sump of material. The substitution, however, is a possibility which is not considered to be the preferred embodiment of the present invention but a workable alternative.

U.S. patents set forth in this application are intended to be incorporated by reference herein.

It is apparent that there has been provided in accordance with this invention a process and apparatus for electromagnetically forming a material into a desired thin strip shape which fully satisfies the objects, means, and advantages set forth hereinabove. While the invention has been described in combination with specific embodiments thereof, it is evident that many alternatives, modifications, and variations will be apparent to those skilled in the art in light of the foregoing description. Accordingly, it is intended to embrace all such alternatives, modifications, and variations as fall within the spirit and broad scope of the appended claims.

We claim:

1. A casting process comprising the steps of:

electromagnetically forming a molten material into a desired thin strip shape having a thickness of less than approximately 2.5 millimeters, said forming step comprising the steps of:

providing an electromagnetic casting apparatus having a first axis extending therethrough in the direction of casting;

delivering said molten material into said electromagnetic casting apparatus;

applying a first electromagnetic field to contain and form said molten material into a cross-sectional shape substantially the same as said desired thin strip shape;

applying a second electromagnetic field, position downstrean and adjacent said first electromagnetic field, to said molten material having said cross-sectional shape so that distortion caused by surface tension in said cross-sectional shape is reduced and the desired thin strip shape is maintained, the second field applying step including the step of providing a shaped inductor having an inner surface forming a substantially closed inner periphery surrounding said molten material, said inner surface being formed of two pairs of opposing side walls with the side walls of each pair being substantially identical, said inner surface of each of said side walls being simultaneously contoured concavely longitudinally of said first axis and convexly transversely of said first axis; and applying a third electromagnetic field at the liquid to solid boundary of the material, said third electromagnetic field acting in conjunction with the surface tension in the molten thin strip for balancing the hydrostatic pressure head in the molten material so that the desired thin strip shape is maintained.

2. The process of claim 1 further including the step of reducing the strength of the second electromagnetic field as compared to the strength of the first electromagnetic field.

3. The process of claim 2 wherein the strength of the third electromagnetic field is stronger than said second electromagnetic field.

4. The process of claim 3 further including the step of reducing the second electromagnetic field at the corners of the molten thin strip.

5. The process as set forth in claim 4 including the step of providing a sump to contain said molten material, said sump having at a top surface thereof a substantially larger cross-sectional area as compared to the cross-sectional area of a bottom surface thereof wherein said bottom surface corresponds substantially to said thin strip shape.

* * * * *